US005221044A

United States Patent [19]

Guins

[11] Patent Number: 5,221,044

[45] Date of Patent: Jun. 22, 1993

[54] RAIL FASTENING SYSTEM WITH GAGE ADJUSTMENT MEANS

[76] Inventor: Sergei G. Guins, 4496 Dobie Rd., Okemos, Mich. 48864

[21] Appl. No.: 810,631

[22] Filed: Dec. 19, 1991

[51] Int. Cl.[5] ..... E01B 9/48

[52] U.S. Cl. ..... 238/349; 238/297; 238/331

[58] Field of Search ..... 238/297, 298, 349, 351, 238/264, 265, 282, 331, 29

[56] References Cited

U.S. PATENT DOCUMENTS

| | | | |
|---|---|---|---|
| 801,278 | 10/1905 | Terwilleger | 238/265 |
| 926,788 | 7/1909 | Warfield | 238/265 |
| 2,357,499 | 9/1944 | Royce et al. | 238/349 |
| 3,581,990 | 6/1971 | Kirik | 238/283 |
| 3,784,098 | 1/1974 | Serafin et al. | 238/283 |
| 4,143,818 | 3/1979 | Matsubara et al. | 238/265 |
| 4,405,081 | 9/1983 | Tack | 238/283 |
| 4,454,986 | 6/1984 | Taylor et al. | 238/349 X |
| 4,469,278 | 9/1984 | Jerman | 238/349 |
| 4,494,695 | 1/1985 | Sonneville | 238/265 |
| 4,688,719 | 8/1987 | Young et al. | 238/351 |
| 4,756,477 | 7/1988 | Schumaker | 238/297 X |
| 4,770,343 | 9/1988 | Heim et al. | 238/351 |
| 4,946,099 | 8/1990 | Bratchell | 238/351 X |
| 4,967,954 | 11/1990 | von Lange | 238/349 X |

FOREIGN PATENT DOCUMENTS

| | | | |
|---|---|---|---|
| 0206618 | 12/1986 | European Pat. Off. | 238/349 |
| 3507310 | 9/1986 | Fed. Rep. of Germany | 238/349 |

*Primary Examiner*—Michael S. Huppert
*Assistant Examiner*—James T. Eller, Jr.
*Attorney, Agent, or Firm*—Marshall & Melhorn

[57] ABSTRACT

There is disclosed a rail fastening system for wood or concrete ties having provisions for rail gage adjustment and including a pair of shoulders removably secured to a railway tie plate or a shoulder retaining in a concrete tie with provisions for lateral adjustment of the rails by the placing of a series of spacers between the flange base of the rail and the shoulders, with the dimensions of the spacers selected to provide constant deflection of the rail clips, if used, regardless of the adjusted position of the rail.

4 Claims, 3 Drawing Sheets

RAIL FASTENING SYSTEM WITH GAGE ADJUSTMENT MEANS

BACKGROUND OF THE INVENTION

I. Field of the Invention

This invention relates to a railway fastening system for holding a rail onto wood or concrete ties, or other supporting structure, while providing a simple and reliable means to allow lateral adjustment of the rail as may be required to maintain gage adjustment, i.e., to compensate for worn rails, and at the same time provide a system having easily replaceable parts so that the system will not be damaged in the event of a derailment or other unexpected event.

II. Description of the Prior Art

The railroads have long used conventional tie plates to fasten rails to wooden ties to distribute the load produced by the wheels of the rolling stock of the railroad, such as railroad cars and locomotives to the ties, which in turn spread the load to the ballast and the ground. The conventional tie plate also is a means of maintenance of the spacing between the rails which is accomplished by the shoulders of the tie plates that control the lateral position of the rail on the tie.

Originally, it was thought that once the tie plate was fastened to the tie, and the rails were fastened to the tie plate, that the lateral position of the rail was fixed and would need no changing. However, as greater and greater loads are placed onto the rails, rail wear has become increasingly evident, especially on the inside, or gage faces, of the rail.

The inside faces of the rail can be worn on level tracks simply by the side-to-side movement of the rail cars, and on curves the situation can be aggravated if the speed of the train does not balance the loads on the curves. At the "curve balanced" speed, both rail faces would carry an equal load, but at an overspeed condition, the high rail takes more gage face wear because the flange rubs against the rail gage face with artificially increased forces. This situation will be reversed at speeds below the balance speed because the low rail will carry more of the force, thus squashing the rail head.

With these conditions becoming aggravated by longer and heavier rail cars, research has been under way as to how to adjust the gage of the rails. It was thought that this could not be done without completely removing the sections of the rail and reversing them, taking a pair of rails off and transposing the same or taking the rails off to a salvage point and welding them into strings for cascading by placing them on a secondary line, etc. However, these approaches are all labor intensive, and thus, very expensive and unsatisfactory. Furthermore, on the new concrete ties with welded rails which can approach a quarter mile long, the process becomes even more difficult, as only transposing an excessively long rail, or moving it to a secondary track, is practical, both of which can be done only at great expense.

In order to provide for lateral adjustment without having to transpose or reverse the rails, it was thought that moving the conventional tie plate over, at least on wood ties, would solve the problem. However, it was found that the amount of adjustment that was needed was very small, such as in quarter inch increments, and that the tie plate could not be moved this small a distance without re-spiking. Also, while the tie plate usually provides for two spike patterns, so that the tie plate can be moved, it was found that the life of the ties was lessened because of the exposure to the elements of the holes which were no longer being used, and this "spike killing" of the tie became very expensive due to reduced life of the tie.

It was thought that the problem of rail gage adjustment, at least for continuous rails on concrete ties, was solved with the invention patented in the U.S. Pat. No. 4,405,081, dated Sep. 20, 1983, to Carl E. Tack, now owned by the assignee of the present application, and also comprising the closest piece of prior art of which I am aware. While the system disclosed in the Tack patent works perfectly as long as there is no damage to the concrete ties such as by derailments, etc., it was found in operation that because the shoulders are one piece and cast into the concrete ties that, if there is any derailment, or near derailment, the shoulders become damaged and unusable, causing the need for replacement of the concrete tie, which is very expensive. Thus, this solution, while previously thought completely adequate, was found to be imperfect, and thus the long-standing problem in the art of how to provide for lateral adjustment of rails on wood and concrete ties still remained.

SUMMARY OF THE PRESENT INVENTION

The present invention provides for a rail fastening system for wood or concrete ties having provisions for rail gage adjustment, as well as replacement of parts which become damaged due to railway accidents or other causes. A pair of shoulders removably secured to a railway tie plate, or a shoulder retaining means in a concrete tie, provide for lateral adjustment of the rails by placing of a series of spacers between the flanged base of the rail, and the shoulder supports, with the dimensions of the spacers selected to provide constant deflection of rail clips, if these are used, regardless of the adjusted position of the rail. In addition, the fact that these shoulders are removably attached makes their replacement easy if they are damaged in a railway accident.

Thus, it is an object of the present invention to provide a railway fastener system usable on both wood and concrete ties which provides for lateral adjustment of the rails.

It is a further object of the present invention to provide for lateral adjustment of rails without spike killing of wooden ties.

It is a further object of the present invention to provide a rail fastening system which eliminates tie plate cutting due to the relative movement between tie plates and ties.

It is a still further object of the present invention to provide a rail fastening system which provides for complete wear out of the rail in place, without the need for reversing, transposing, or cascading of the rail.

It is a further object of the present invention to provide a rail fastening system which allows for the change in rail gage without movement of the tie plate.

It is a further object of the present invention to provide a rail fastening system with gage adjustment which is easily repairable in case of a railway accident.

It is a further object of the present invention to provide a rail fastening system providing for rail gage adjustment which is relatively simple in construction and inexpensive to manufacture.

It is a further object of the present invention to provide a rail fastening system which is usable with a variety of shoulders which are adapted to accept a like variety of rail fastening clips.

It is a further object of my present invention to provide a rail fastening system usable with either wood or concrete ties.

It is a further object of the present invention to provide a rail fastening system usable with continuously welded rail.

Further objects and advantages of the present invention will be apparent from the following description and appended claims, reference being made to the accompanying drawings forming a part of the specification, wherein like reference characters designate corresponding parts in the several views.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description and not of limitation.

DETAILED DESCRIPTION OF THE PREFERRED EMBODIMENTS OF THE PRESENT INVENTION

Figure 1:
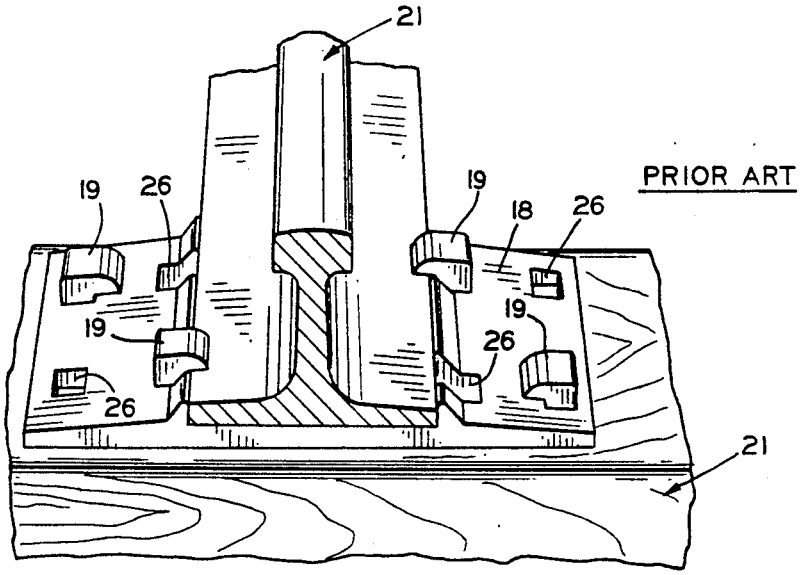
FIG. 1 is a perspective view, partially cut away, showing a prior art rail fastening system.

Referring now to FIG. 1, there is shown the prior art rail fastening system wherein a conventional tie plate 18 is spike to the tie, generally designated by the numeral 21 by spikes 19 placed through several of the spike holes 26. In turn, the rail, generally designed by the numeral 20, is spiked to the tie plate by spikes 19 placed through other of the spike holes 26. It is noted that certain of the spike holes 26 are not used. The spikes shown in the prior art of FIG. 1 form a first attachment pattern, while if the tie plate is to be moved, and spikes were then placed in the unused holes, a second attachment pattern would be formed which is diagonally opposite of the first attachment pattern.

It was when the tie plate was attempted to be moved in prior attempts at adjustment of rail gages that uncovered holes were left where the spikes were previously in the tie, and that moisture got into the tie at these points and rotted out the tie, thus "killing" the tie, and causing premature tie replacement costs. It was for this reason that efforts to move the tie plate on wood rails were abandoned.

It should also be noted that the prior art rail fastening means really only provided for lateral restraint of the rail 20, as the forces provided by only two spikes per rail were insufficient to prevent up and down movement of the rails.

Because of this problem, it was found desirable to move to rail fastening means which provided a positive downward force on the rail. Two of such fastening means are known in the art as the "Pandrol" clip, and the "McKay" clip, which fit into permanent shoulders cast into the tie plates, or in the case of concrete ties, permanent shoulders cast into the ties in the manufacturing process. However, these permanent shoulders were subject to damage in the case of derailments, or near derailments, when the wheels of the railcar would run over the shoulders, thus causing premature replacement of concrete ties, or tie plates in the case of wooden ties. Thus it was clear to me that I needed to develop a rail fastening system which involved a permanent placement of a tie plate, but yet had removable shoulders in case said shoulders became damaged by unforeseen railway accidents.

Figure 2:
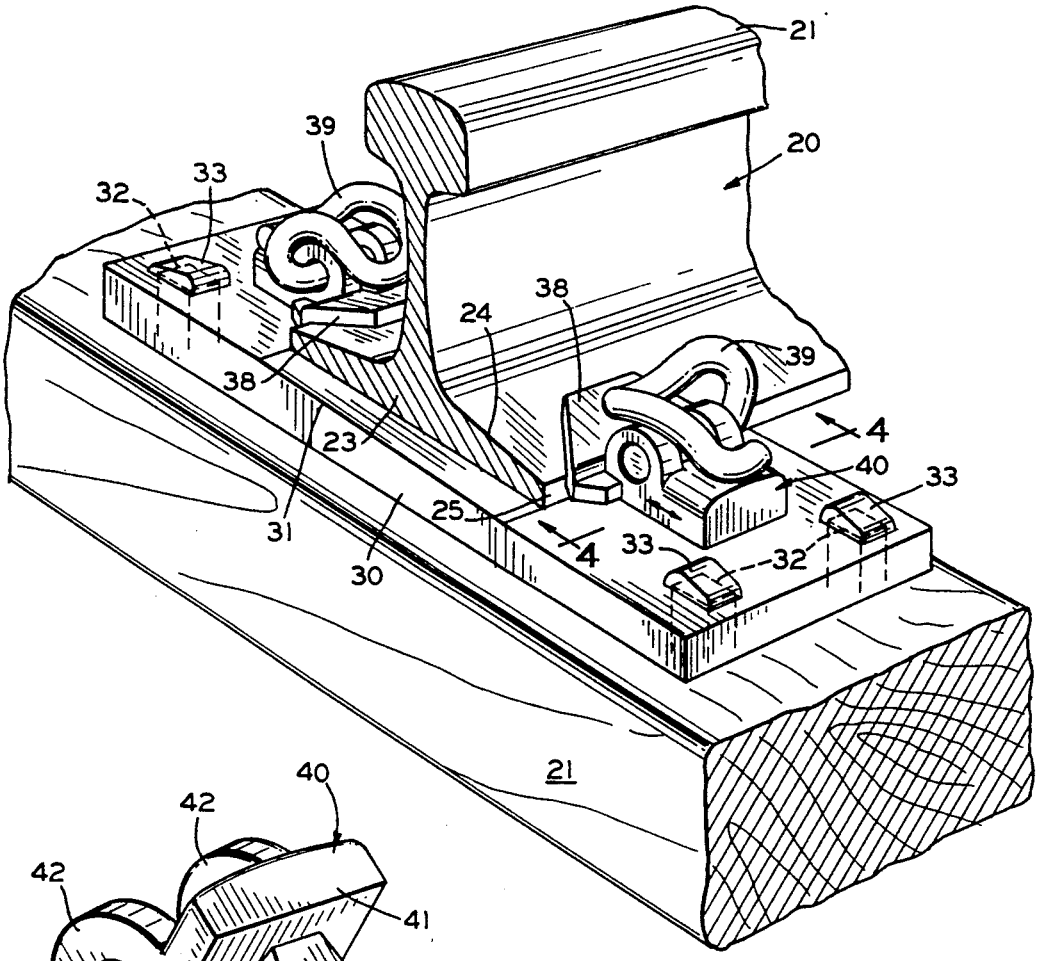
FIG. 2 is a perspective view, partially cut away, of a rail fastening system embodying the construction of the present invention.
Figure 3:
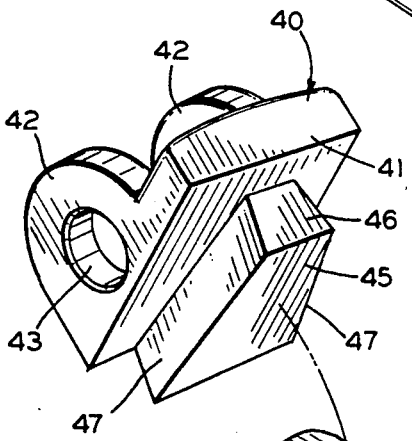
FIG. 3 is an exploded view, partially in section showing the operation of the shoulder retaining means of the present invention.
Figure 3:
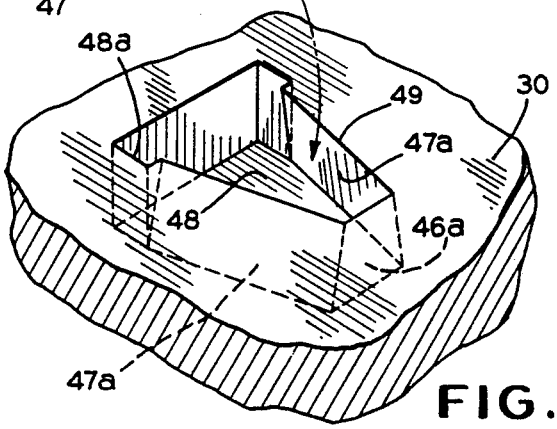
Figure 4:
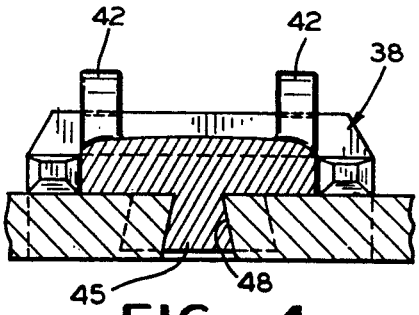
FIG. 4 is a sectional view, taken in the direction of the arrows, along the section line 4—4 of FIG. 2.

FIG. 2 shows the solution to this longstanding problem in the art. Referring to FIGS. 2–4, there is shown one embodiment of my improved rail fastening system showing a rail, generally designated by the numeral 20, mounted to a tie 21 through the use of a tie plate 30 which is of a construction embodying the present invention. The tie plate 30 has a tapered portion 31, which is standard in the industry, to tilt the rail slightly inward to center the railway car truck. I use a normal taper of 1 in 40 although some applications may call for a taper of 1 in 30, or some other taper depending upon the particular applications. The tie plate 30 has spike holes 32 into which a plurality of spikes 33 are driven. Since there is no need to move the tie plate with my invention, I utilize four spike holes 32 in each tie plate, which allows the placing of four spikes 33 in each tie plate 30.

The rail 20 has a head portion 22, and a base portion 23 with a downwardly sloping wall 24 terminating in lower edge 25. Against the lower edge rests a spacer, generally designated by the numeral 38, which is pressed downwardly against the downwardly sloping wall 24 by the clip 39, which is in turn restrained in the shoulder generally designated by the numeral 40. In this instance, the clip 39 which is illustrated, is known in the trade as a "Pandrol" clip, although, as will be seen below my construction may be used with a wide variety of clips.

Referring now to FIGS. 3 and 4, the detailed construction of the shoulder and the shoulder retaining means can be seen. The shoulder 40 has a base portion 41 integral therewith on which are formed a pair of clip retaining portions 42 having axially aligned openings 43 therein which retain the Pandrol clip 39. Formed integrally with, and protruding below the base portion 41, is a wedge shaped lug 45 having a forward wall 46, and a pair of side walls 47 in the form of inclined ramps. It is important to note that the wedge 45 is formed by the inclined ramps 47 converging in a direction away from a rail resting on the tie plate. In order to retain the shoulder 40 in place on the tie plate 30, a slot 48 having a slot portion 48A and a tapered socket 49 is provided. The forward and side walls of the tapered socket 49, labelled 46*a* and 47*a* respectively, are complimentary in shape to the forward wall and side walls of the lug portion 45 of the shoulder 40 the wedge the shoulder in place in the tapered socket 49 of the tie plate 30.

Figure 9:
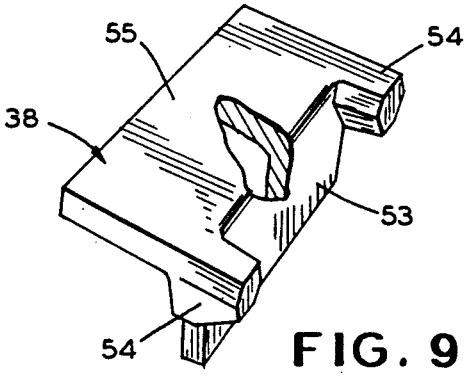
FIG. 9 is a cutaway perspective view showing one embodiment of a spacer which may be used with the present invention.
Figure 6:
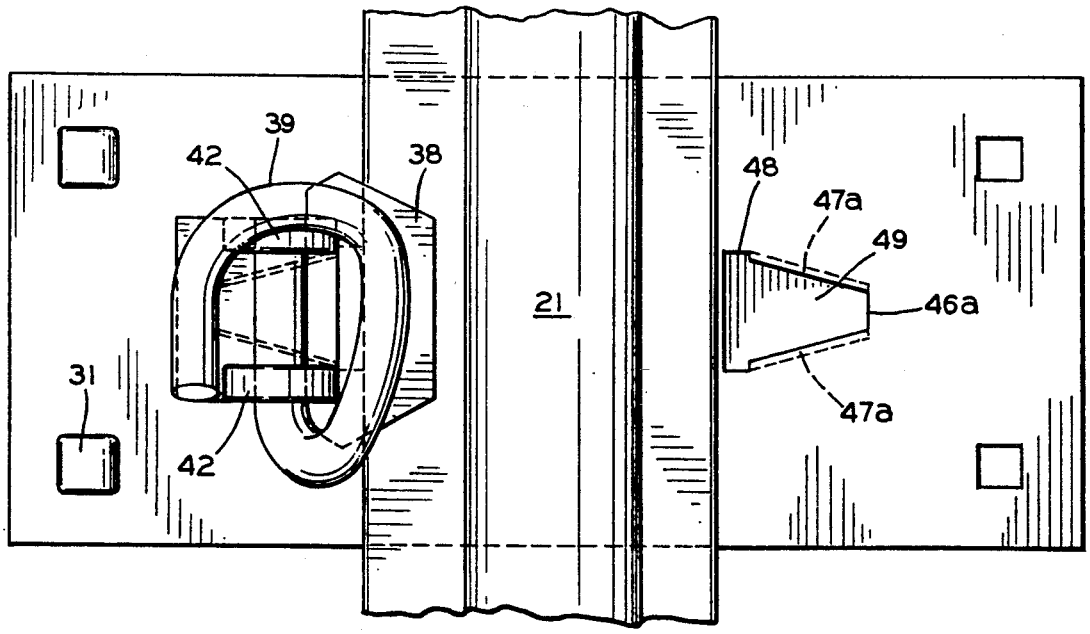
FIG. 6 is a partial plan view of a rail fastener system embodying the construction of the present invention.

It should be understood that although the "double wedge" shape of the slot 48 is preferred, the side walls of the wedge 45 and tapered socket 49 need not converge toward each other as illustrated best in FIGS. 3 and 6, but could be parallel, or of some other shape, and still be within the scope of the present invention, as long as the wedge 45 is held in the slot 48 with sufficient force to perform its function. The spacer, generally designated by the numeral 38, is best seen in FIG. 9 and has a vertical wall portion 53, an inclined wall portion 55 and a pair of lug portions 54. The vertical wall 53 will fit in the slot 48 immediately adjacent the shoulder 40. The inclined wall portion 55 will overlap the flanged base 24 of the rail. After the rail 20 is placed on the tie 21, the shoulders 40 are inserted in the tapered sockets 49, the spacers are then inserted into the slots 48, and then the clips 39 are slid in the openings 43 provided in the clip retainer portions 42 of the shoulder 40. In this way the rail is positively located both against lateral and vertical movement.

It should be understood that it is not necessary to use a spacer in the present invention although it is preferred. It is contemplated that the spacer and shoulder may be combined in some applications with the position of the wedged shape lug and the dimensions of the clip adjusted to still hold the rail firmly in place, or the spacer may be eliminated altogether in certain instances. However, normally it will be used.

Figure 7:
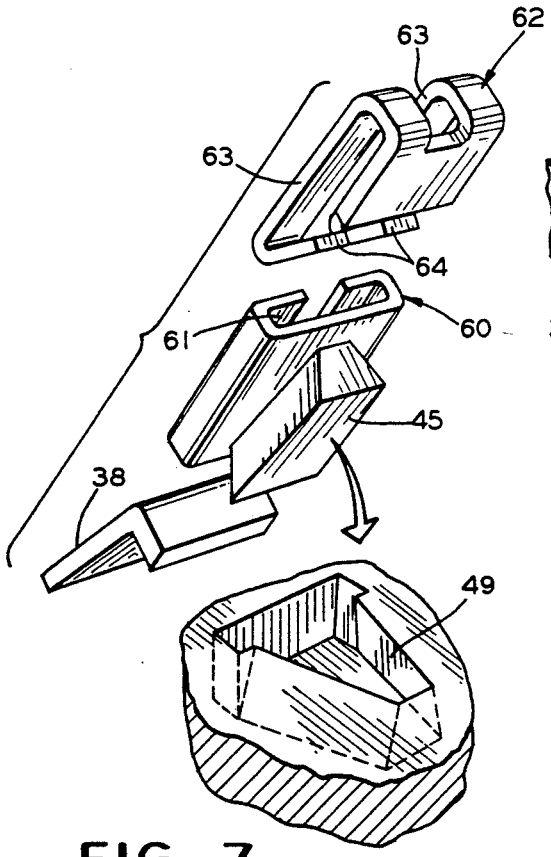
FIG. 7 is a partial exploded view showing a modification of my invention using a McKay clip.
Figure 8:
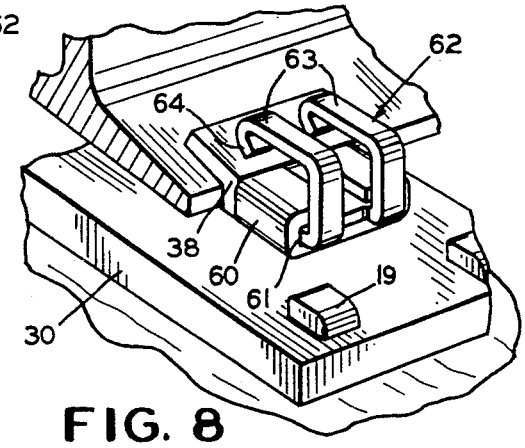
FIG. 8 shows an assembly view showing the parts illustrated in FIG. 7 assembled to a tie plate and holding a rail in place.

By simply making my shoulders of a different design, provision can be made for use of any desired type of rail clip. Illustrated in FIGS. 7 and 8 is an assembly which may be used for a McKay clip. The McKay shoulder, now designated by the numeral 60 to differentiate it from the shoulder 40 used for a Pandrol clip, still has the wedged shaped lug 45 thereon which fits into the tapered socket 49, with the spacer 38 then inserted into the slot 48 after the rail 20 is put in place. In this instance, the clip retainer portion of the McKay clip 62 takes the form of an open slot 61 which accepts the McKay clip, generally designated by the numeral 62, which has a pair of arms 63 having angled portions 64 at the end thereof.

With the McKay clip 62, the shoulder 60 is first inserted into the tapered socket 49, the rail is laid in place, the spacers 38 are next installed, and the McKay clip 62 is driven into the slot 61 and is held therein in place by friction sufficient to provide the necessary forces to hold down the rail 20.

With regard to the spacer 38, since the vertical wall 53 is substantially similar in dimension to the portion of the tapered socket 49 into which it fits, the lug portions 54 of the spacer 38 may be eliminated if desired.

It can be understood that my improved rail fastening system can be used with a wide variety of clips and fastening means merely by varying the type of shoulder which is used.

Figure 5:
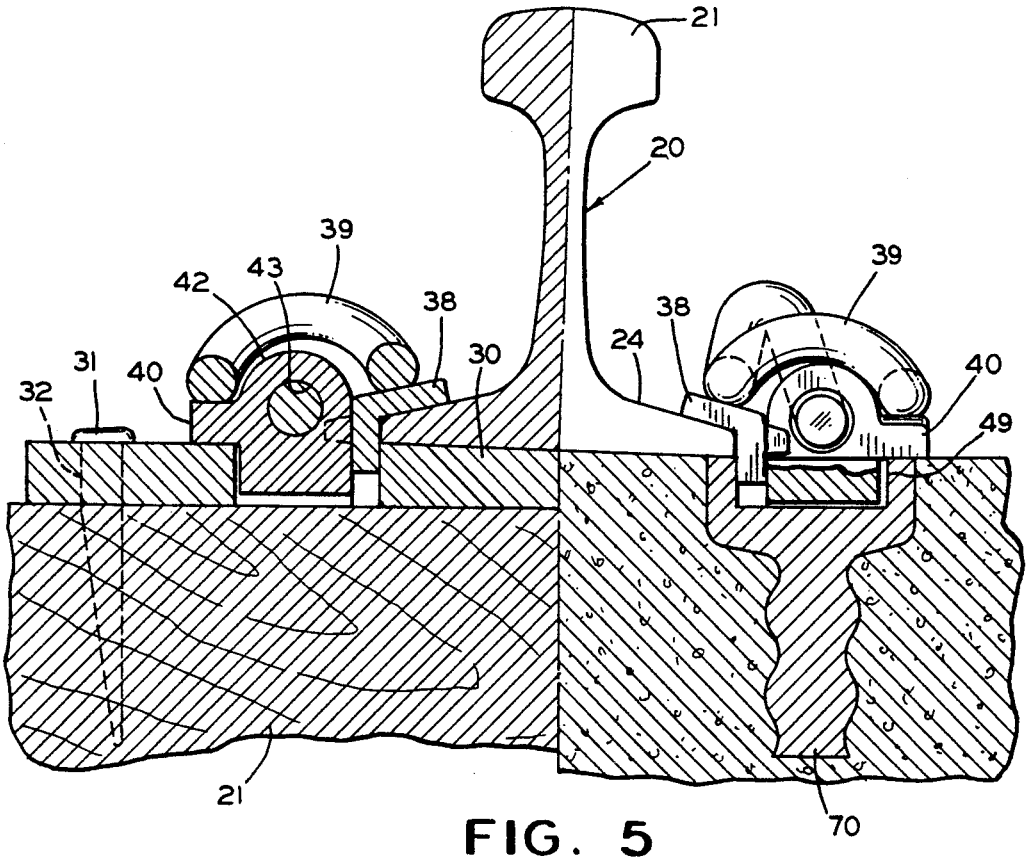
FIG. 5 is a modified elevational view showing a side-by-side comparison of the present invention illustrating embodiments of the invention used on wood and concrete ties.

Referring now to FIG. 5, a comparison of how my improved rail fastening means may be used on concrete ties, as well as on wood ties, is shown in the side-by-side comparison illustrated. In this case, instead of having a one piece shoulder and anchor as shown in the U.S. Pat. No. 4,405,081 to Charles E. Tack, I have a separate anchor and shoulder provided. The anchor 70 may be shaped similarly to that shown in the Tack patent but instead of having the shoulder 40 formed integrally therewith, it has the tapered socket 49 formed therein. Therefore, the shoulders can be the same as used with my rail fastening system on wood ties, thereby saving expense and avoiding the need for different hardware to be used with concrete ties. The shoulder 40 having the wedge shaped lug 45 merely is placed in the tapered socket 49 as before, the spacer 38 is inserted, and the clip 39 is slid into the shoulder 40. With the shoulder 40 being separately replaceable if damaged by a derailment or other type of accident, much expense is saved over that which was used in the prior art.

The McKay clip 62 would be used in a similar fashion. If it was desired to change the type of shoulder, for example, to use the McKay shoulder 60, one had to replace the whole concrete tie. One could not merely slide out the Pandrol shoulder 40, slide in the McKay shoulder 60, and use a different type of clip such as the McKay clip 62. Thus, I have provided not only a less expensive rail fastening system for concrete ties, but a more versatile and flexible fastening system for use on concrete ties then was available before.

Whether my rail fastening system is used with the Pandrol clip 40 or the McKay clip 62, and their corresponding removable shoulders (40, 60), and whether it is used with wood or concrete ties, the dimensioning of spacers 38 which are used will be such as is disclosed in the said U.S. Pat. No. 4,405,081, the specification of which is specifically incorporated herein by reference.

Therefore, by carefully analyzing the requirements of rail fastening systems, I have provided a novel, simple and inexpensive system for fastening rails to all types of ties, while at the same time providing for gage adjustment.

I claim:

1. A rail fastening and gauge maintaining system including in combination:

(a) a tie;

(b) a tie plate mounted to said tie, said tie plate having at least one shoulder retaining means provided therein, said shoulder retaining means including a slot portion for receiving a spacer therein, and a wedge-shaped socket portion, said wedge-shaped socket portion including a pair of inclined ramps converging in a direction away from a rail resting on said tie plate and diverging in a direction into said tie plate;

(c) a shoulder including a wedge-shaped lug portion complimentary in shape to said wedge-shaped socket portion, said wedge-shaped lug portion slidably inserted in said wedge-shaped socket portion, wherein said shoulder is wedged in place in said wedge-shaped socket portion;

(d) a rail resting on said tie plate adjacent said shoulder;

(e) a spacer positioned between said rail resting on said tie plate adjacent said shoulder, and said shoulder, to maintain the gauge of said rail; and (f) a resilient clip extending from said shoulder and bearing on said spacer to hold said rail down on said tie plate.

2. The system defined in claim 1, wherein said spacer is a part of a set of individual spacers, said spacers being substitutable for one another between said rail and said shoulder.

3. The system defined in claim 2, wherein each spacer has a vertical wall portion and an inclined wall portion, wherein the thickness of the vertical wall portion of each spacer is different, and the sum of the thickness of any selected pair of vertical wall portions is constant, said resiliant clips engaging the inclined wall portions of said spacer, said inclined wall portions of said spacers having different thickness within each set, whereby constant deflection of said resilient clips is provided regardless of the adjusted position of said rail.

4. The system defined in claim 3, wherein said tie plate includes an upper surface, a portion of said upper surface being tapered to tilt a rail mounted thereon inwardly.

* * * * *